US007654290B2

(12) United States Patent
Colditz et al.

(10) Patent No.: US 7,654,290 B2
(45) Date of Patent: Feb. 2, 2010

(54) METHOD FOR TRANSPORTING A WEFT THREAD THROUGH THE SHED OF A WEAVING MACHINE

(75) Inventors: Jan Colditz, Chemnitz (DE); Matthias Sachse, Chemnitz (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/288,043

(22) Filed: Oct. 16, 2008

(65) Prior Publication Data

US 2009/0101226 A1 Apr. 23, 2009

(30) Foreign Application Priority Data

Oct. 19, 2007 (EP) ..... 07020515

(51) Int. Cl.
*D03D 45/50* (2006.01)
*D03D 47/30* (2006.01)
*D03D 51/12* (2006.01)

(52) U.S. Cl. ..... 139/435.2; 139/435.1; 139/116.1; 139/1 R; 139/452

(58) Field of Classification Search ..... 139/1 R, 139/116.1, 435.1–435.6, 452
See application file for complete search history.

(56) References Cited

U.S. PATENT DOCUMENTS 3,900,603 A * 8/1975 Rittmayer et al. ..... 148/537
4,102,362 A * 7/1978 Tojo ..... 139/435.1
4,398,568 A * 8/1983 Rydborn ..... 139/1 R
4,503,891 A * 3/1985 Novak et al. ..... 139/116.2
4,620,570 A * 11/1986 Suzuki ..... 139/116.2
4,664,157 A * 5/1987 Shin ..... 139/116.2
4,784,188 A * 11/1988 van Mullekom ..... 139/116.2
4,917,153 A * 4/1990 Mori et al. ..... 139/435.1
4,932,442 A * 6/1990 Ishido et al. ..... 139/435.2
5,735,316 A * 4/1998 Hehle ..... 139/194
7,195,039 B2 * 3/2007 Schaich et al. ..... 139/274
2004/0039474 A1 * 2/2004 Kontani ..... 700/140
2005/0034775 A1 * 2/2005 Schaich et al. ..... 139/435.1
2005/0203659 A1 9/2005 Siegl

FOREIGN PATENT DOCUMENTS

DE 199 00 581 A1 7/2000
EP 0 344 104 A1 11/1989
EP 1 473 391 A1 11/2004
JP 6033339 A 2/1994

* cited by examiner

*Primary Examiner*—Bobby H Muromoto, Jr.

(57) ABSTRACT

A method for transporting the weft thread through the shed of an air-jet weaving machine having a nozzle fed with a flowing transportation medium, wherein the portion, changeable along the weft thread, of the natural thread charges arranged irregularly on the weft thread is contactlessly registered by means of an electrode array, wherein the changing total charge is determined on the electrode array, wherein the periodic change in the total charge is evaluated for determining the axial velocity of the weft thread, and wherein the nozzle of the weaving machine is controlled as a function of the axial velocity of the weft.

15 Claims, 2 Drawing Sheets

METHOD FOR TRANSPORTING A WEFT THREAD THROUGH THE SHED OF A WEAVING MACHINE

CROSS REFERENCE TO RELATED APPLICATIONS

This application claims priority of European Patent Office application No. 07020515.8 EP filed Oct. 19, 2007, which is incorporated by reference herein in its entirety.

FIELD OF INVENTION

The invention relates to a method for transporting a weft thread through the shed of a weaving machine with the aid of at least one nozzle fed with a flowing transportation medium. The invention relates further to a weaving machine having at least one nozzle fed with a flowing transportation medium for transporting a weft thread through the shed of the weaving machine.

BACKGROUND OF INVENTION

In air-jet weaving machines a directed air jet that conveys the weft thread in free flight through the shed is produced by means of air nozzles. A plurality of groups of air nozzles (main nozzles, relay nozzles) are for that purpose controlled staggered in time by pneumatic valves. The function of the main nozzles is to accelerate the weft thread. The relay nozzles guide the tip of the thread through the shed.

The air nozzles are usually controlled according to a predefined schedule. Correct setting of the activation instants is therein dependent on, inter alia, the material of which the thread is made, the air pressure, and the prevailing climatic conditions and is based frequently on experimental values obtained from weaving trials.

It is known how to measure the weft thread's launch and arrival. The weft thread's launch is therein defined as the instant at which the weaving machine's thread brake is released and compressed air applied to the main nozzles. The thread's arrival is measured by two optical sensors. Its flight is modeled very coarsely through linear interpolating between its launch and arrival, with a uniform straight-line motion generally being assumed. The resulting interpolated straight line is then shown in a "nozzle settings" user display. Highly incorrect settings of the air nozzles can be seen in said display and have to be adjusted manually by changing the parameters step by step.

SUMMARY OF INVENTION

An object of the present invention is to optimize transporting of the weft thread in a weaving machine of the aforementioned type.

Said object is achieved by means of a method for transporting a weft thread through the shed of a weaving machine with the aid of at least one nozzle fed with a flowing transportation medium, which

- contactlessly registers the portion, changeable along the weft thread, of the natural thread charges arranged irregularly on the weft thread by means of, an electrode array and determines the changing total charge on the electrode array,
- evaluates the periodic change in the total charge for determining the weft thread's axial velocity, and
- controls the weaving machine's at least one nozzle as a function of the weft thread's axial velocity.

Said object is further achieved by means of a weaving machine having at least one nozzle, fed with a flowing transportation medium, for transporting a weft thread through the shed of the weaving machine,

- having a measuring device embodied for contactlessly registering the portion, changeable along the weft thread, of the natural thread charges arranged irregularly on the weft thread by means of an electrode array and determining the changing total charge on the electrode array,
- having an evaluation unit embodied for evaluating the periodic change in the total charge for determining the weft thread's axial velocity, and
- having a control unit embodied for controlling the weaving machine's at least one nozzle as a function of the weft thread's axial velocity.

Advantageous embodiments are indicated in the dependent claims.

The weft thread's axial velocity is its speed in its longitudinal direction (thread axis).

An idea of an embodiment is the preferably automatic controlling of the nozzles (main and/or relay nozzles) as a function of the weft thread's axial velocity, especially with controlling the relay nozzles. The weft thread's axial velocity is for that purpose determined using a contactless measuring method. The measuring device required therefore operates on the basis of the physical principle, described in the German patent DE 199 00 581 B4, of a non-optical spatial-filtering method, which is to say a spatial-filtering method that employs a non-optical detector.

The measuring method is based on registering the portion, changeable along the weft thread, of the natural thread charges arranged irregularly on the weft thread by means of the electrostatic induction effect emanating from them, with the weft thread moving past a single detector containing an electrode array having a periodically—in the thread's axial running direction location-specifically—changing sensitivity to the electrostatic induction effect and producing a changing total charge at least in a part of the electrode array, with a temporally approximate periodic change in its total charge being registered on the detector, and with the changing total charge on the electrode array being determined as a narrow-band frequency spectrum concentrated around a main component, with said main component's frequency being proportional to the axial velocity of the weft thread being moved past.

For further specifics of the measuring method and measuring device, reference is made to the German patent DE 199 00 581 B4, the full scope of whose contents (Description, Claims, Drawings) is hereby encompassed within the present patent application and hence to be regarded as an equal-ranking constituent of this patent application. Reference is in particular made to paragraphs [0001] to [0004] and paragraphs [0032] to [0082], to claims 1 to 13 there, and to FIGS. 1 to 13.

Attention is drawn particularly to the non-optical detector's having a grid-shaped electrode array that consists of grid rods that are electrically conducting but mutually separated by a non-conducting intermediate zone and arranged mutually parallel in the thread's vicinity at a distance that avoids contact, with the grid rods being preferably

- oriented transversally to the thread moving past, and
- arranged side-by-side in the thread's axial running direction, and
- connected in groups that are electrically conducting among each other, with a grid rod belonging to one group in each case alternating in the thread's axial running direction with a grid rod belonging to another group, arranged having a fixed geometric assignment to the thread moving past, and arranged side-by-side in a periodically recurring sequence, and of the same type at least in groups among each other.

The weft thread's flight can be modeled extremely accurately. The weft thread's axial velocity can for that purpose be registered at one location on the flight path or at a plurality thereof. The weaving machine's air nozzles can be set or even regulated automatically. What is especially advantageous is automatic regulating of the relay nozzles. Disturbing environmental influences such as, for instance, variations in air humidity can therein be compensated as can also material tolerances in the weft-thread material. The quality of weft insertion can be monitored and optimized. Weft insertion problems can be detected and classified more precisely. The weaving machine will be made simpler to set up. The necessary setup times will consequently also be reduced. The currently employed, comparatively sensitive optical sensor technology can be replaced.

BRIEF DESCRIPTION OF THE DRAWINGS

The invention is described below with the aid of exemplary embodiments that are explained in more detail with reference to drawings. In a simplified, in part schematic form.

DETAILED DESCRIPTION OF INVENTION

Figure 1:
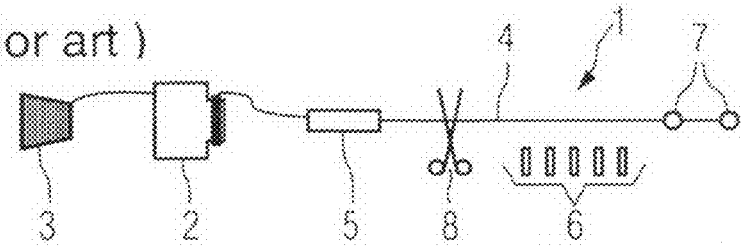
FIG 1 ( Prior art )
FIG. 1 shows a weaving machine's most important machine parts along the weft thread's filling path (prior art)

Identical reference numerals employed in the figures explained in detail below correspond to elements having identical or comparable functions.

The motion of the shafts is in a weaving machine 1 coupled to the angle of rotation of the weaving machine's main shaft. As of a defined angle of rotation one shaft moves upward and another downward. The shed is opened thereby. The shed should be open for as long as possible as that will prolong the available weft insertion time.

For example half the warp threads are suspended from each shaft in the simple example described here having two shafts. If there are more than two shafts then a plurality of groups of threads will be distributed among the shafts. The invention can, though, be applied also to weaving machines not employing any shafts. Weft inserting takes place while the shed is still being opened. The yarn length necessary for weft inserting is pulled off from the weft bobbin 3 by a pre-winding device 2. In air-jet weaving machines a directed air jet that conveys the weft thread 4 in free flight through the shed is produced by means of air nozzles. A pre-nozzle (not illustrated) and a main nozzle 5 tauten the weft thread 4 and accelerate it up to filling speed as soon as the weft thread 4 has been released by the pre-winding device 2. The groups of relay nozzles 6 are then activated one after the other based on the predefined angle of machine rotation or the filling duration. An arrival sensor 7 registers when the weft thread 4 has attained the weaving width. The weft thread 4 is caught by a suction nozzle (not illustrated) or, as the case may be, extended through an extension nozzle (not illustrated). The function of the extension nozzle can therein be assumed by the last group of relay nozzles. The weaving comb (batten, reed) attaches the weft thread 4 to the finished textile and the thread shears 8 located on the weaving comb cut off the weft thread 4. The shafts then change over position, as a result of which on the one hand the shed will be closed and, on the other, the warp threads crossed over. The weft thread 4 will be securely enclosed thereby. Withdrawing of a predefined length of fabric is finally initiated. The most important machine parts of a weaving machine 1 along the filling path of the weft thread 4 are shown in FIG. 1.

A multiplicity of pneumatic elements are employed in an air-jet weaving machine. The air nozzles 5, 6 are controlled via magnetic or, as the case may be, piezoelectric switching valves. Magnetic switching valves 9 are used in the cases herein described. A sealing element is therein either opened or closed with the aid of a magnet. Although, having switching times of around 5 ms, these components are slower than piezoelectric valves they nonetheless permit a high volume flow and are economical. Magnetic switching valves 9 can assume two states: "Open" and "Closed".

Alongside the switching time of the magnetic switching valves 9, the machine control's switching time constitutes a major criterion for air consumption. The longer the pre-switching time has to be, particularly of the relay nozzles 6 owing to the control cycle time, the greater the air consumption will be. In view of the fact that pneumatic elements can account for more than 50% of an air-jet weaving machine's energy consumption, that can be significantly affected by any changes in the nozzle-opening times. Energy savings of up to 10% and more are possible through optimizing the switching times.

Correctly setting a weaving machine 1 is a very tedious and demanding task. That is why textile machine manufacturers constantly endeavor to shorten the setting process to make the machines more attractive to the textile industry with short setup times.

Figure 2:
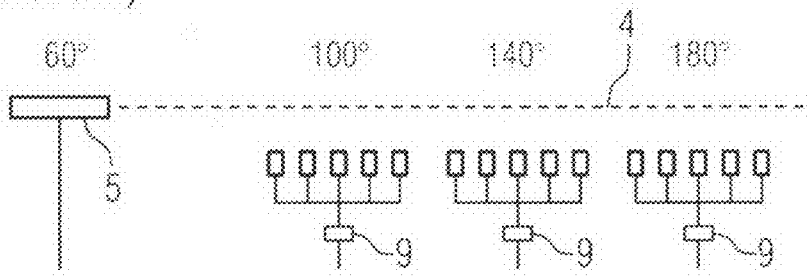
FIG 2 ( Prior art )
FIG. 2 shows the principle of setting a machine angle (prior art)
Figure 3:
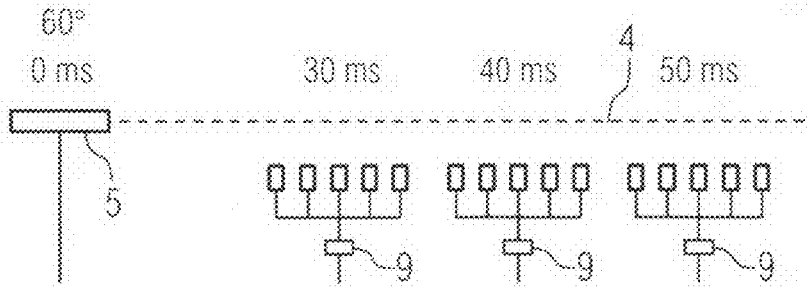
FIG 3 ( Prior art )
FIG. 3 shows the principle of a time-controlling means (prior art)

Various machine setup concepts are known from the prior art. Said concepts differ basically in being based either on setting the machine angle or on time controlling. With machine angle setting the activation and deactivation instant of the main nozzle 5 and relay nozzles 6 is dependent on the angle of rotation of the main shaft of the weaving machine 1, as illustrated in a simplified manner in FIG. 2. That constitutes the simplest form of setting up a machine. What, though is disadvantageous are the necessary setup time and requisite resetting of the machine when the machine's rotational speed changes. That system does not permit account to be taken of tolerances in material properties. With time controlling the nozzles are controlled based on fixed times. In contrast to machine angle setting it is possible to change the rotational speed without the need for time-consuming resetting. Only the starting instant of the overall nozzle control process is shifted in accordance with the main shaft's rotational speed. The pneumatic process will start earlier with increasing rotational speed and later with decreasing rotational speed. The relay nozzles 6 switch with a time delay after the main nozzle 5 has been triggered. Time controlling of that type is illustrated in a simplified form in FIG. 3.

Figure 4:
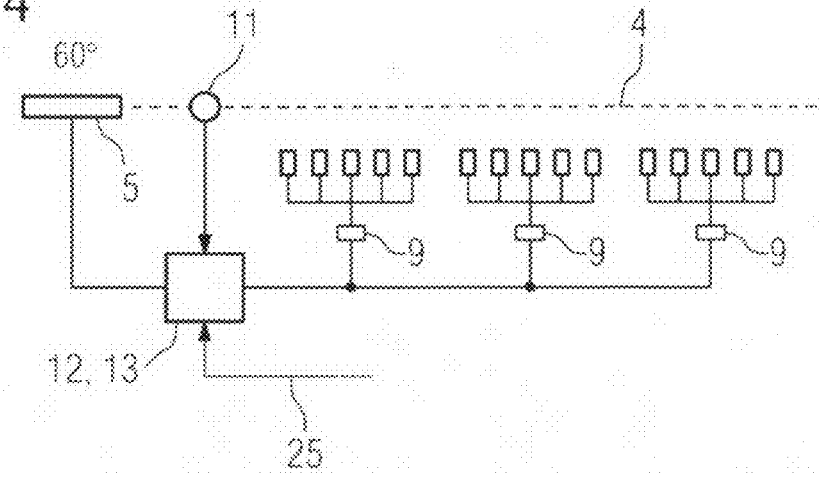
FIG. 4 shows the principle of the inventive controlling means.

A weaving machine is inventively fitted with a measuring device referred to below as the sensor 11 for short, see FIG. 4. As will be explained further below, the axial velocity of the weft thread 4 is determined in an evaluation unit 12 with the aid of the signals registered by the sensor 11. A control unit 13 then automatically controls the relay nozzles 6 as a function of the axial velocity of the weft thread 4. For the present application instance it has proved especially advantageous for the sensor 11 to be located downstream of the main nozzle 5. That is because only a single sensor 11 will then be required for all colors (web-thread rolls). The sensor 11 can, though, basically be located anywhere along the thread's course.

The sensor 11 is embodied for registering the portion, changeable along the weft thread, of the natural thread charges arranged irregularly on the weft thread by means of the electrostatic induction effect emanating from them. The sensor 11 for that purpose includes a detector 14 arranged such that the weft thread 4 will move past it. The detector 14 includes an electrode array 15 having a periodically—in the thread's axial running direction 16 location-specifically—changing sensitivity to the electrostatic induction effect. The weft thread 4 moving past the detector 14 produces a changing total charge at least in a part of the electrode array 15. A temporally approximate periodic change in the total charge is therein registered on the detector 14, with the changing total charge on the electrode array 15 being determined as a narrow-band frequency spectrum concentrated around a main component. The frequency $f_H$ of said main component is proportional to the axial velocity of the weft thread 4 being moved past, see DE 199 00 581 B4.

Figure 5:
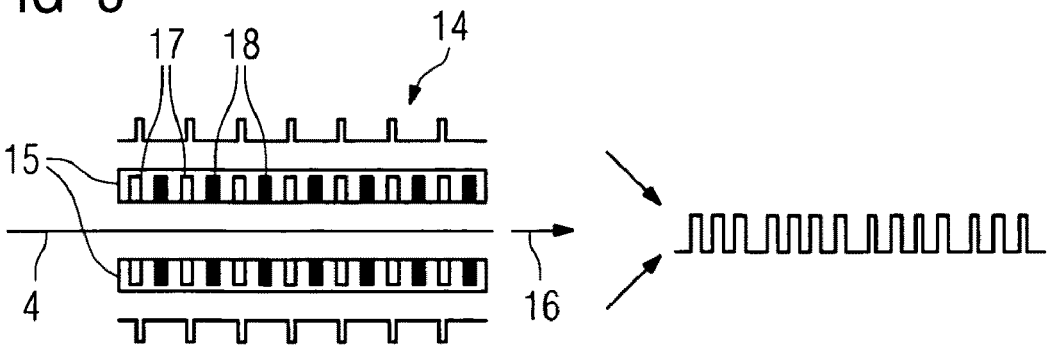
FIG. 5 shows the principle of the spatial filter.

In other words an electrostatic spatial-filtering method wherein the weft thread is guided in between two segments forming the electrode array 15, see FIG. 5, is presented. Seated on each segment are alternating shield-grid electrodes 17 and measuring electrodes 18. The shield-grid electrodes 17 separate the measuring electrodes 18 from each other. Thus a charge transfer will in each case be electrostatically induced by a charge on the weft thread 4 in one measuring electrode 18 only. The charges will be transferred back to their initial status if the weft thread 4 moves on. Once the relevant piece of thread is located above the next measuring electrode 18 the process will start there anew. The period of time between the charge transfers is dependent on the velocity of the piece of thread and on the distance between the measuring electrodes 18. A frequency proportional to the velocity will develop in the voltage signal. The second segment has the same structure as the first except that all the electrodes are therein displaced by the distance between two electrodes. The consequence thereof is that the first segment supplies a signal, the second segment does not, and vice versa. The two segments' signals can as a result be compared in a difference amplifier and noise effects reduced. The spatial filter principle of the sensor 11 and functioning mode are shown in FIG. 5.

The evaluation unit 12 is embodied for evaluating the periodic change in the total charge for determining the axial velocity of the weft thread 4. The periodically changing total charge is for that purpose converted into periodic voltage fluctuations as the useful signal. The evaluation unit 12 is furthermore embodied for suppressing a part of the frequency spectrum outside the main component. The evaluation unit 12 has for that purpose an adjustable filter element, in particular an automatically readjustable one. It is preferably a bandpass filter 19 (band filter for short). Provided for the band filter 19 is a control component 21 embodied for automatically setting the center frequency of the band filter 19 in keeping with the currently measured frequency $f_H$ of the main component.

Figure 6:
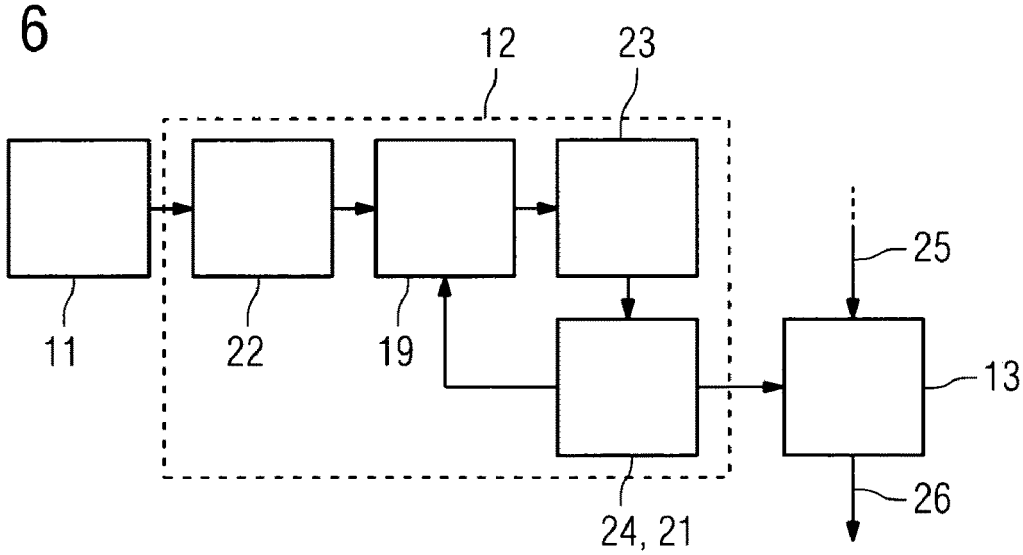
FIG. 6 shows the sensor, evaluation unit, and control unit.

The evaluation unit 12 comprises specifically a pre-amplifier 22, the band filter 19, a post-amplifier 23, and a signal processing unit 24, see FIG. 6. Having been generated in the sensor 11 from the stochastically distributed charge of the weft thread 4, the signal is amplified in the pre-amplifier 22. With the aid of the band filter 19 it then undergoes filtering, which is described in more detail further below. It is then post-amplified by means of the post-amplifier 23. It is digitalized or, as the case may be, converted into a frequency-modulated rectangular signal in the signal processing unit 24 which follows on and has the difference amplifier, see FIG. 5, right-hand side. The signal processing unit 24 serves also as a control component 21 for the band filter 19. Said unit includes for that purpose a PLL (Phase-Locked Loop, not illustrated) embodied preferably as a constituent of a VCO (Voltage-Controlled Oscillator). For comparing the signals of the two segments of the electrode array 15 the signal processing unit 24 also includes a difference amplifier (not illustrated).

The signal processing unit 24 is an electronic data processing unit and includes inter alia an analog-to-digital converter and a digital signal processor (DSP). Instead of the DSP it is possible also to use another digital microcontroller, an application-specific integrated circuit (ASIC), a field programmable gate array (FPGA), or a complex programmable logic device (CPLD). The signal processing unit 24 furthermore includes a conventional data processing processor that interacts with data input and data output units. The data processing unit further includes a computer program embodied for being executed in the processor. The computer program includes computer program instructions for executing the described steps of the method that are assigned to the signal processing unit 24 and for implementing the functionalities described (difference amplifier etc.) when the computer program is executed in the data processing unit. An alternative possibility instead of the computer program executed in the processor is to provide in the data processing unit a special digital circuitry structure (FPGA, ASIC, CPLD, . . . ) through whose operation the described steps of the method that are assigned to the signal processing unit 24 and the functionalities described will be carried out or, as the case may be, made available.

A filter has to be used in order to filter out (in particular low-frequency) interference that is present in the signal and would otherwise preclude signal utilizing of any practical value. A non-variable, fixed filter element cannot be used therefor owing to the weft thread's strong dynamic characteristics (accelerations up to 20,000 $m/s^2$) and the consequent different signals at the start of filling on the one hand and during ongoing filling on the other because the useful frequencies present at the start of thread accelerating become interference frequencies later in the filling action. A fixed filter element is unable to remove the frequencies from the useful signal that cause the error.

Figure 7:
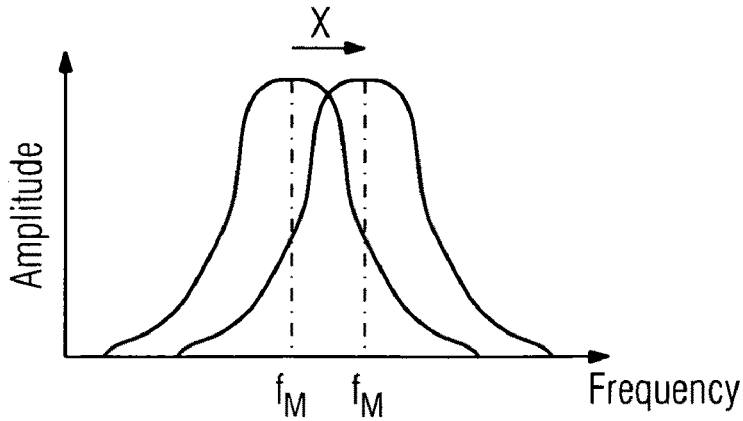
FIG. 7 shows shifting of the band filter's center frequency.

The requisite filtering can readily be provided by means of an adjustable filter element. The band filter 19 is for that purpose matched to the current measured frequency. In other words the filter characteristics are adjusted automatically in keeping with the signals measured. If a correspondingly embodied band filter 19 that can be controlled via the control component is used then the center frequency of the band filter 19 will for that purpose be set in accordance with the current axial velocity of the weft thread 4, see FIG. 7.

The bandwidth of the band filter 19 has preferably been set in such a way that the useful signal will not depart from the bandwidth within the time up to when the center frequency is updated. The required bandwidth is hence dependent on the acceleration of the weft thread 4 and on the cycle time of the filter control realized by means of the signal processing unit 24. Proceeding from the weft thread's extremely strong dynamic characteristics (acceleration), the sensor signal passes through a frequency band of, for example, 5 kHz per millisecond (with the detection electrodes spaced, for instance, 4 mm apart). The bandwidth within the range of the start of accelerating is preferably limited to approximately 5 kHz because the bandwidth will otherwise at higher frequencies become too great for useful signal conditioning. The signal processing unit 24 must in that case update the center frequency within 1.5 ms. The clock signal of the PLL is used for establishing the center frequency $f_M$ of the band filter 19 employed.

The principle on which signal conditioning operates is as follows: The center frequency $f_M$ of a bandpass above a clock frequency generated by the PLL has at the start of filling been superimposed on the start-of-filling frequency+X. In keeping with the measured useful signal and the frequency determined there from, the control component in the signal processing unit 24 sends a voltage signal to the PLL, which generates a new clock signal that the band filter 19 superimposes on the current useful signal frequency+X. X is therein substantially dependent on the bandwidth of the band filter 19 and on the cycle time of the control component in the signal processing unit 24.

The filter element is preferably a digital filter that is highly flexible and whose parameters are simple to set with the aid of a digital signal processor. Instead of a digital filter it is also possible to use an SC (switched capacity) filter whose parameters can be set with the aid of, for example, an SPS control.

The axial velocity is linked to the frequency of the useful signal's main component by way of a mathematical relationship and so can be calculated in the signal processing unit 24. By way of an integration operation it is furthermore possible in the signal processing unit 24 to determine the position of the tip of the weft thread 4 at a defined later instant from the axial velocity of the weft thread 4 at the sensor 11. The thread length can also be determined so that the sensor 11 can serve also as a thread-length sensor. To summarize, the picking course of the weft thread 4 can be simulated by means of the arrangement described. Especially comprehensive information evaluating and, in association therewith, especially precise and comprehensive controlling of the weaving machine 1 will be possible if not only the useful signals of the sensor 11 but also signals 25 of the other types of sensors (launch of thread, arrival of thread, etc.) are brought together in the evaluation unit 12 and used for evaluating.

The information of relevance for controlling the relay nozzles 6 is conveyed by the evaluation unit 12 to the control unit 13, which is embodied for automatically controlling the relay nozzles 6 as a function of the axial velocity of the weft thread 4. What is therein to be understood by controlling a nozzle is its activation and, where applicable, also deactivation in this case by actuating the magnetic switching valves 9. In other words it is a matter of determining the activation instants of the relay nozzles 6. The control unit 13 is therein embodied preferably such that the relay nozzles 6 arranged in groups will be activated in succession once the tip of the weft thread 4 has reached their region of action. Preferably not only will the controlling instant of the relay nozzles 6 be set once only; the relay nozzles 6 will also be controlled automatically for each weft filling so that regulating will be present. The control unit feeds out a controlling signal 26 for controlling the relay nozzles 6, see FIG. 6.

The necessary measuring accuracy of the sensor 11 depends on two criteria: Firstly, on the cycle time (reaction time) of the means employed for controlling the air-jet path and, secondly, on the velocity of the yarn being inserted. The signal for controlling the relay nozzles 6 will as a basic rule be given by the control unit 13 in advance. That lead time must be at least the same as the time up until when the nozzle control signal is applied (meaning as the delay caused on the control side) plus the duration of nozzle opening (including the delay of the magnetic switching valves). The measuring tolerance of the sensor 11 must also be added thereto.

The control unit 13 can feed out a signal only at the beginning of each cycle, with "cycle" being understood as the time up until when all input parameters are next read in and all output parameters fed out. The measuring error of the sensor 11 must therefore be less than half the thread-flight length within a cycle. In the specific instance, tolerance ranges of a few centimeters result for the tested yarn material given a cycle time of 1.5 ms. The accuracy of the sensor 11 can be increased with the aid of a more accurate reaction of the controlling means to the start of weft filling and the end of thread insertion.

The invention claimed is:

1. A method for transporting a weft thread through the shed of a weaving machine with a nozzle fed with a flowing transportation medium, comprising:

registering contactlessly the portion, changeable along the weft thread, of the natural thread charges arranged irregularly on the weft thread by means of the electrostatic induction effect emanating from them, wherein the weft thread moves past a single detector and produces a changing total charge at least in a part of an electrode array, wherein the single detector contains the electrode array having a periodically, in the thread's axial running direction location-specifically, changing sensitivity to the electrostatic induction effect;

registering the total charge of the detector based upon a temporally approximate periodic change;

determining the changing total charge on the electrode array as a narrow-band frequency spectrum concentrated around a main component, wherein said main component's frequency is proportional to the axial velocity of the weft thread being moved past;

evaluating the periodic change in the total charge for determining the axial velocity of the weft thread; and controlling the nozzle of the weaving machine as a function of the axial velocity of the weft thread.

2. The method as claimed in claim 1, further comprising:

determining the position of the tip of the weft thread at a later instant from the axial velocity of the weft thread at a measuring device, wherein that position information is used for controlling the nozzle of the weaving machine.

3. The method as claimed in claim 1, further comprising:

activating the nozzle once the tip of the weft thread has reached the region of action of the nozzle.

4. The method as claimed in claim 2, further comprising:

activating the nozzle once the tip of the weft thread has reached the region of action of the nozzle.

5. The method as claimed in claim 1, wherein the weaving machine has a main nozzle and a relay nozzle, wherein the main nozzle or the relay nozzles is controlled as a function of the measuring result of the measuring device.

6. The method as claimed in claim 1, wherein the weaving machine has a main nozzle and a relay nozzle, wherein the main nozzle and the relay nozzles are controlled as a function of the measuring result of the measuring device.

7. The method as claimed in claim 2, wherein the weaving machine has a main nozzle and a relay nozzle, wherein the main nozzle and the relay nozzles are controlled as a function of the measuring result of the measuring device.

8. The method as claimed in claim 1, wherein the nozzle is controlled for each weft filling as a function of the axial velocity of the weft thread.

9. A weaving machine with a nozzle fed with a flowing transportation medium for transporting a weft thread through the shed of the weaving machine, comprising:

a measuring device for registering the portion, changeable along the weft thread, of the natural thread charges arranged irregularly on the weft thread by means of the electrostatic induction effect emanating from them, wherein the weft thread moves past a single detector and produces a changing total charge at least in a part of an electrode array, wherein the single detector contains the electrode array having a periodically, in the thread's axial running direction location-specifically, changing sensitivity to the electrostatic induction effect, wherein the total charge of the detector is registered based upon a temporally approximate periodic change, and wherein the changing total charge on the electrode array is determined as a narrow-band frequency spectrum concentrated around a main component, wherein said main component's frequency is proportional to the axial velocity of the weft thread being moved past;

an evaluation unit embodied for evaluating the periodic change in the total charge for determining the axial velocity of the weft thread; and a control unit for controlling the nozzle of the weaving machine as a function of the axial velocity of the weft thread.

10. The weaving machine as claimed in claim 9, wherein the evaluation unit converts the periodically changing total charge into periodic voltage fluctuations as useful signal.

11. The weaving machine as claimed in claim 10, wherein the evaluation unit suppresses a part of the frequency spectrum outside the main component.

12. The weaving machine as claimed in claim 11, wherein the evaluation unit has an automatically readjustable filter element for suppressing a part of the frequency spectrum outside the main component.

13. The weaving machine as claimed in claim 11, wherein the filter element is a band filter, and wherein a control component is provided for the band filter for automatically setting the center frequency of the band filter in keeping with the currently measured frequency of the main component.

14. The weaving machine as claimed in claim 9, wherein the evaluation unit has a signal processing unit having a Phase-Locked Loop embodied as a constituent of a voltage-controlled oscillator.

15. The weaving machine as claimed in claim 9, further comprising:

a main nozzle, wherein the measuring device is located downstream of the main nozzle; and a relay nozzle.

* * * * *